US005735537A

United States Patent [19]

Zorzi

[11] Patent Number: 5,735,537

[45] Date of Patent: Apr. 7, 1998

[54] BRAKING DEVICE PARTICULARLY FOR SKATES

[75] Inventor: Claudio Zorzi, Paderno Di Ponzano Veneto, Italy

[73] Assignee: Nordica S.p.A., Trevignano, Italy

[21] Appl. No.: 433,119

[22] Filed: May 3, 1995

[30] Foreign Application Priority Data

May 13, 1994 [IT] Italy ..... TV94A0051

[51] Int. Cl.[6] ..... A63C 17/14

[52] U.S. Cl. ..... 280/11.2; 280/11.22; 188/5

[58] Field of Search ..... 280/11.19, 11.2, 280/11.22, 11.27, 11.23, 11.36; 188/5

[56] References Cited

U.S. PATENT DOCUMENTS

| | | | |
|---|---|---|---|
| 5,174,070 | 12/1992 | Pellegrini, Jr. et al. | 280/11.22 |
| 5,211,409 | 5/1993 | Mitchell . | |
| 5,335,924 | 8/1994 | Richards, Sr. et al. | 280/11.2 |
| 5,397,137 | 3/1995 | Pellegrini, Jr. et al. | 280/11.2 |
| 5,435,579 | 7/1995 | Pozzobon | 280/11.2 |
| 5,435,580 | 7/1995 | Balbinot et al. | 280/11.22 |
| 5,439,238 | 8/1995 | Neal | 188/5 |
| 5,462,296 | 10/1995 | Pozzobon | 188/5 |
| 5,465,984 | 11/1995 | Pellegrini, Jr. et al. | 280/11.2 |
| 5,487,552 | 1/1996 | Daoust | 280/11.2 |

FOREIGN PATENT DOCUMENTS

| | | |
|---|---|---|
| 0567948 | 11/1993 | European Pat. Off. . |
| 0585764 | 3/1994 | European Pat. Off. . |
| 0594080 | 4/1994 | European Pat. Off. . |

*Primary Examiner*—Brian L. Johnson
*Assistant Examiner*—Min Yu
*Attorney, Agent, or Firm*—Hale and Dorr LLP

[57] ABSTRACT

A braking device, particularly for skates, including a shoe composed of a quarter that is articulated to a shell which is in turn associated with a frame to which two or more wheels are pivoted. The braking device is constituted by a substantially U-shaped elastic support that has V-shaped lateral wings; a brake pad is associated with the ends of the wings. The support also has a base that is pivoted transversely to the quarter.

23 Claims, 3 Drawing Sheets

BRAKING DEVICE PARTICULARLY FOR SKATES

BACKGROUND OF THE INVENTION

The present invention relates to a braking device particularly for skates.

The problem of braking the wheels in order to adjust the speed of the skate is currently felt in conventional roller skates, whether constituted by a shoe that is associated with a support for two pairs of mutually parallel wheels or constituted by a shoe that is associated with a supporting frame for one or more aligned wheels.

In conventional skates, adapted blocks or pads, usually made of rubber, are placed at the toe or heel regions and when the user tilts the shoe, forward or backward, the pad interacts with the ground and braking is thus achieved.

The drawback of these conventional brakes is that the user must rotate the whole skate jeopardizing his/her balance.

U.S. Pat. No. 1,402,010 discloses a roller skate having a strap that can be fastened on the user's leg above the malleolar region and to which a rod is connected.

The rod surrounds the rear of the leg and is curved so as to laterally affect said leg. The rod ends are associated, in the malleolar region, with a lever assembly that is articulated to a structure that protrudes from the wheel supporting frame.

The lever assembly protrudes at the rear of the frame and is connected to a plate that is shaped approximately complementarily to the curvature of part of an underlying and facing wheel.

This solution, also, has drawbacks: first of all, a relative motion occurs between the strap and the leg throughout sports practice, and this does not make its use comfortable due to the continuous rubbing of the strap on the leg.

Furthermore, the plate is activated every time the user bends his leg backward beyond a given angle, without true and easy possibilities of varying this condition.

Still, since the shape of the leg is different for each user, braking is achieved for different rotation angles for an equal rod length.

The rod also acts and presses in the malleolar region, and this can cause discomfort or produce accidental impacts.

Finally, considerable wheel wear is observed.

U.S. Pat. No. 4,275,895 discloses a brake acting on the rear wheels of a skate with mutually parallel pairs of wheels.

Said brake is constituted by a flap that is associated with the shoe in a rearward position; a blade is associated in a rearward position to said flap and is pivoted at the supporting frame of the shoe.

Said blade has, at its free end, a transverse element on which two C-shaped elements are formed at the lateral ends; said elements interact, following a backward rotation applied to the flap, with the rear wheels that face said elements, so as to interact with the rolling surface of said wheels.

However, even this solution has drawbacks: it is in fact structurally complicated and therefore difficult to industrialize; it also has adapted springs that allow to reposition the flap in the condition in which the two C-shaped elements do not interact with the wheels, and this further increases structural complexity.

Furthermore, the structural configuration of the brake causes the two C-shaped elements to interact with the wheel even upon a minimal backward rotation applied to the flap and therefore even for involuntary movements; this produces unwanted braking actions and, accordingly, possible loss of balance or coordination.

Finally, the interaction of the C-shaped element at the rolling surface of the wheels leads to rapid wear of said wheels and therefore to non-optimum rolling, which necessarily leads to continuous replacement of said wheels.

U.S. Pat. No. 4,300,781 discloses a brake for skates having pairs of mutually parallel wheels. The brake is constituted by a blade that is pivoted transversely at the rear end of the supporting frame for a shoe; pads are associated with the ends of said blade and face the rolling surface of the pair of rear wheels.

The brake is operated by using a cable that is adapted to rotate the blade in contrast with a spring that is associated with the support for the pair of front wheels, so as to move the pads into contact with the rolling surface of the pair of rear wheels.

Said cable can be activated by means of rings or handles that are associated with a strap that can be placed on the legs of the user by means of temporary connection means.

However, this solution has considerable drawbacks; first of all, brake activation can lead to possible loss of balance during sports practice, because the user's body does not assume a position that is adapted to control the sudden speed reduction; only the hand of the skater is in fact involved in the activation of the brake.

Furthermore, as sports practice can occur while wearing trousers, when traction is applied to the rings the strap may slip along the trousers or drag them so that they slide along the leg, thwarting the braking action.

Furthermore, there is a loose cable that in addition to being a hindrance to the skater can accidentally catch during racing, especially because coordination of the arm-leg movement moves the legs rhythmically laterally outward.

U.S. Pat. No. 4,033,596 discloses a roller-ski that has, in addition to engagement means for the tip of a shoe, braking means that are substantially constituted by a bar that protrudes above a supporting frame for the shoe in the rear region thereof; said bar is pivoted transversely to said frame at one end and has, at the other end, a curved plate for supporting the calf of the user.

A frame is associated transversely and to the rear of the bar; once the bar has been rotated backward, said frame interacts with the rolling surfaces of two wheels that are in turn freely pivoted to the supporting frame for the shoe.

This brake cannot be effectively used for roller skates, because skating entails continuous oscillations of the leg that can lead to unwanted activations of the braking action.

Moreover, the presence of the bar would be dangerous for the user, constituting a blunt body that is completely independent of the leg and might therefore be dangerous in case of a fall.

Furthermore, the described solution does not allow to achieve a gradual braking action.

U.S. Pat. No. 5,388,844 granted on Feb. 14, 1995 discloses a braking device, comprising a rod member connected to the shoe quarter and sliding with respect to the shell. The rod member has a fork-like end that interacts with one or more of the wheels beyond a preset backward rotation angle of the quarter.

Although this solution is undoubtedly an improvement and is valid, it has some small drawbacks related to the fact that it is not possible to easily achieve good graduality in the braking action, as this is mainly entrusted to the skill and sensitivity of the user.

SUMMARY OF THE INVENTION

The aim of the present invention is therefore to solve the described technical problems, eliminating the drawbacks described above in conventional types by providing a braking device for skates that allows to easily achieve good graduality in the braking action.

Within the scope of the above aim, an important object is to provide a braking device that can be activated by the user in case of actual need and never accidentally.

Another important object is to provide a braking device that can be activated rapidly, simply, and safely by the user without said user having to perform movements, for example with his hands, that compromise his balance or coordination.

Another important object is to provide a braking device that protects as much as possible the rolling surface of the wheels from wear.

Another object is to provide a device that associates with the preceding characteristics that of being structurally simple, easy to industrialize, reliable and safe in use, and has low manufacturing costs.

This aim, these objects, and others which will become apparent hereinafter are achieved by a braking device, particularly for skates comprising a shoe having at least one quarter, characterized in that it comprises a substantially U-shaped elastic support having V-shaped lateral wings, a brake member being associated with the ends of said wings, said support also having a base that is pivoted transversely to said quarter.

Advantageously, the braking device has means for adjusting the position of the brake with respect to the ground.

Conveniently, the device may include means for allowing to adjust the control over the flexibility or elasticity of the wings of the support.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figures 1, 2:
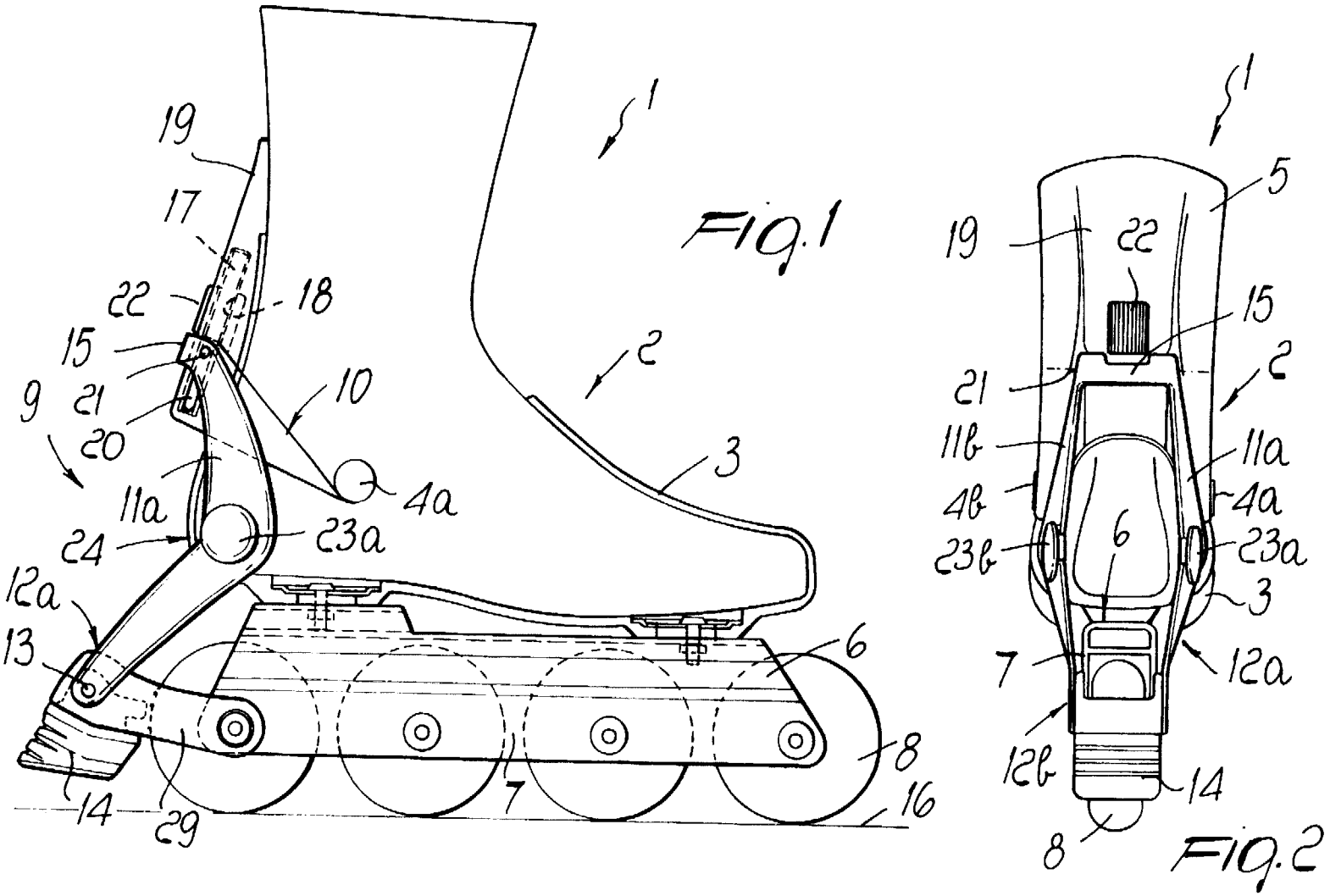
FIG. 1 is a side view of an in-line skate provided with the braking device according to the invention.
FIG. 2 is a rear view of the skate of FIG. 1.

With reference to the above figures, the reference numeral 1 designates a skate comprising a shoe 2 that is composed of a shell 3 to which at least one quarter 5 is articulated at first studs 4*a* and 4*b*.

The shoe 2 is associated with a U-shaped frame 6 and a plurality of aligned wheels 8 are pivoted between the shoulders 7 of said frame.

The braking device, generally designated by the reference numeral 9, is constituted by a substantially U-shaped elastic support 10.

The support also has two substantially V-shaped lateral wings 11*a* and 11*b* that are arranged laterally with respect to the shoe 2 in the region of the heel of the foot.

The tips 12*a* and 12*b* of the lateral wings are pivoted transversely, for example by means of an adapted first pivot 13, to an arm 29 that is oscillatably pivoted to one end of the frame 6; a brake 14 is associated with the arm 29.

The support 10 has a base 15 that connects the lateral wings 11*a* and 11*b* and is transversely pivoted to means, associated with the quarter 5, that allow to adjust the position of the brake 14 with respect to the ground 16.

Said means is constituted by a threaded stem 17, which is accommodated within an adapted first seat 18 that is formed longitudinally within a tab 19 that protrudes to the rear of the quarter 5.

Two parallel slots 20 are formed longitudinally and laterally with respect to the tab 19, and a second pivot 21 is placed at said slots; said pivot 21 is meant to provide a pivoting coupling between the threaded stem 17 and the base 15 of the support 10.

The threaded stem 17 is allowed to move axially with respect to the first seat 18 by virtue of a complementarily threaded knob 22, which is associated with said stem and is in turn associated, without being able to move axially, with the tab 19 and also partially protrudes outside said tab so that it can be activated by the user.

Finally, there is a means for allowing to adjust the control over the flexibility or elasticity of the lateral wings 11*a* and 11*b* of the support 10. Said means is constituted by an adapted pair of blocks 23*a* and 23*b* that can be temporarily accommodated at adapted third seats 24 that are open and are formed at the vertex of the lateral wings 11*a* and 11*b*.

Said blocks are preferably T-shaped, with a stem that can be accommodated within the third seats 24.

The use of the braking device is as follows: after initially associating the pair of blocks that has the desired degree of rigidity at the third seats 24, and after adjusting the knob 22 so that the brake 14, when inactive, does not interact with the ground 16, the user can, during sports practice, achieve gradual braking merely by turning the quarter backwards until the brake interacts with the ground.

Graduality is provided by the elastic deformation that the lateral wings of the support can undergo; this deformation can be contrasted to the desired extend by means of the blocks.

It is thus evident that the invention has achieved the intended aim and objects, a braking device having been obtained that allows the user to achieve optimum graduality in braking.

Furthermore, should the brake 14 wear, or should the user wish to make the braking action occur at a different quarter rotation angle, it is sufficient to turn the knob 22, so as to move axially the threaded stem 17 and therefore the base 15 of the support 10.

The possibility of using blocks made of different materials also allows to customize the degree of flexibility that can be achieved for the lateral wings of the support.

The device according to the invention is of course susceptible of numerous modifications and variations, all of which are within the scope of the same inventive concept.

Figure 3:
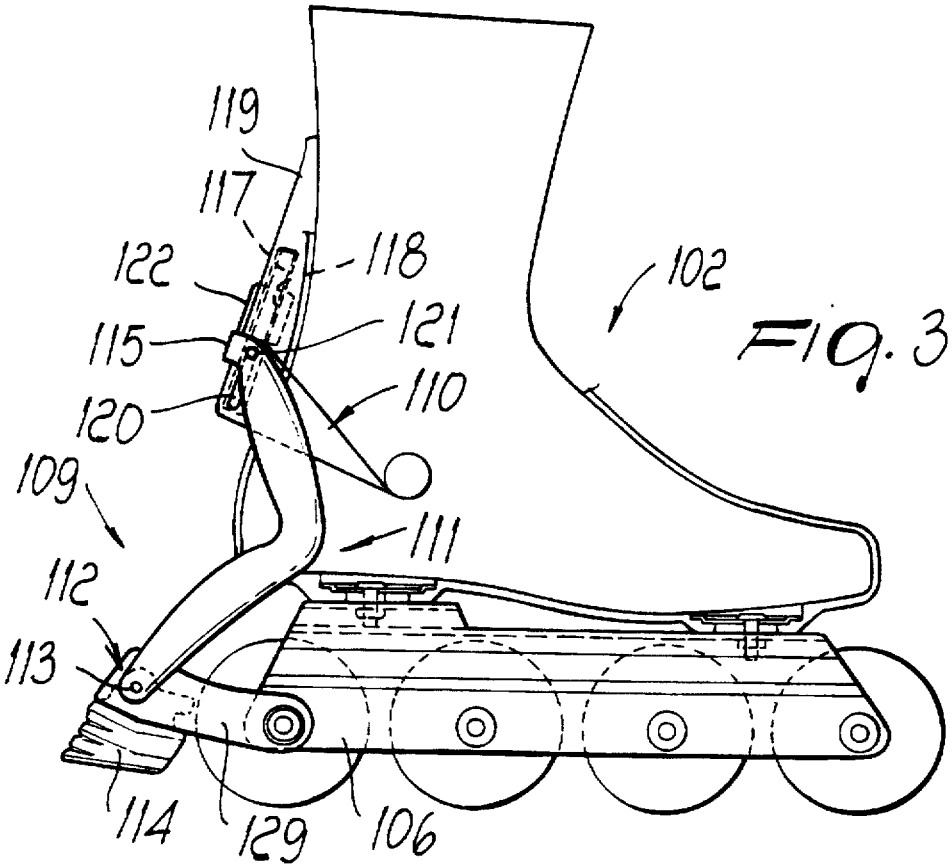
FIG. 3 is a view, similar to the preceding one, of a second embodiment of the braking device.

Thus, for example, FIG. 3 illustrates another embodiment, in which the braking device 109 has, in a simplified form, a substantially U-shaped elastic support 110, with two substantially V-shaped lateral wings 111 that are arranged laterally to the shoe 102 in the region of the heel of the foot.

The tips 112 of the lateral wings are pivoted transversely, by means of an adapted first pivot 113, to an arm 129 that is in turn oscillatably pivoted to one end of the frame 106; a brake 114 is associated with the arm 129.

The support 110 has a base 115 that mutually connects the lateral wings 111; said base is transversely pivoted to a threaded stem 117 that is accommodated within an adapted first seat 118 that is formed longitudinally within a tab 119 that protrudes to the rear of the quarter 105.

Two mutually parallel slots 120 are formed laterally with respect to the tab 119, and a second pivot 121 is arranged at said slots, providing a pivoting coupling between the threaded stem 117 and the base 115 of the support 110.

The threaded stem 117 can move axially with respect to the seat 118 by means of a complementarily threaded knob 122 that is associated therewith. The knob 122 cannot move axially and partially protrudes outside the tab 119 so that it can be activated by the user.

Figure 4:
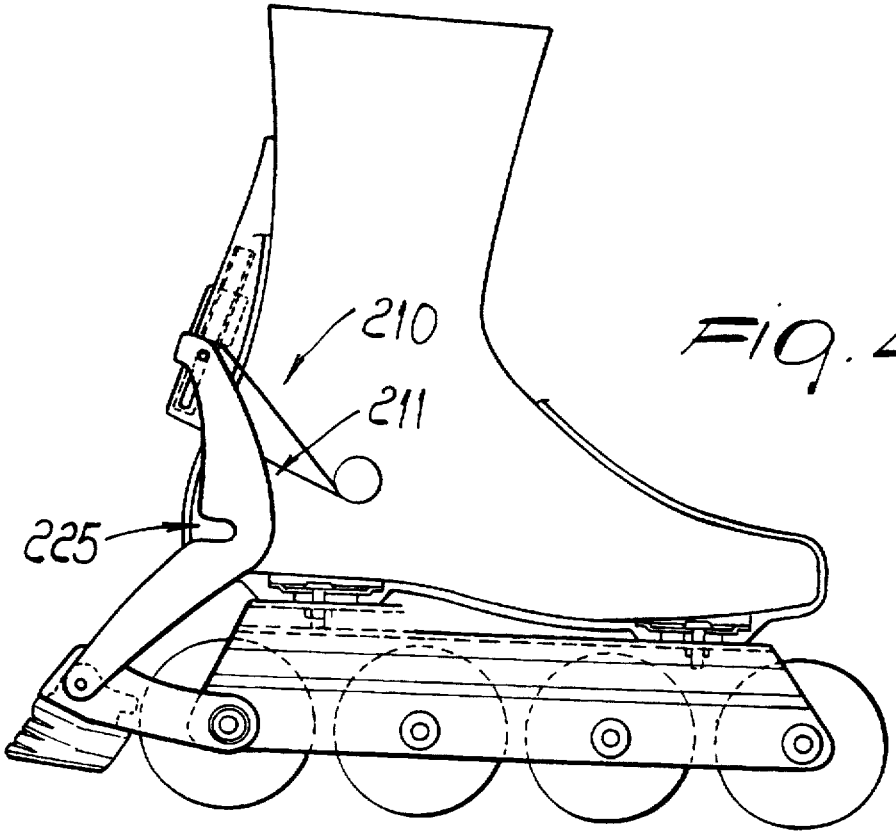
FIG. 4 is a view, similar to the preceding one, of a third embodiment of the braking device.

FIG. 4 illustrates an embodiment in which the lateral wings 211 of the support 210 are again V-shaped; at least one notch 225 is formed at the vertex and is adapted to increase the elastic deformation effect during braking.

Figure 5:
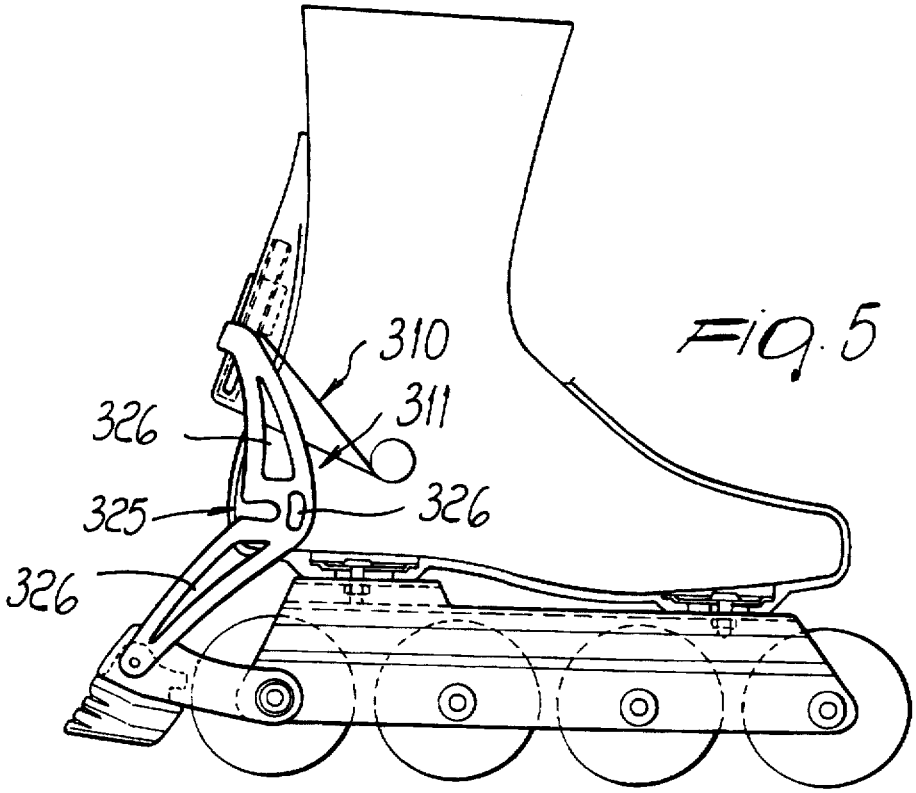
FIG. 5 is a view, similar to the preceding one, of a fourth embodiment of the braking device.

FIG. 5 illustrates a further embodiment, in which the support 310 again has a pair of V-shaped wings 311; a notch 325 is again formed at their vertex and each wing has one or more cutouts 326.

Figure 6:
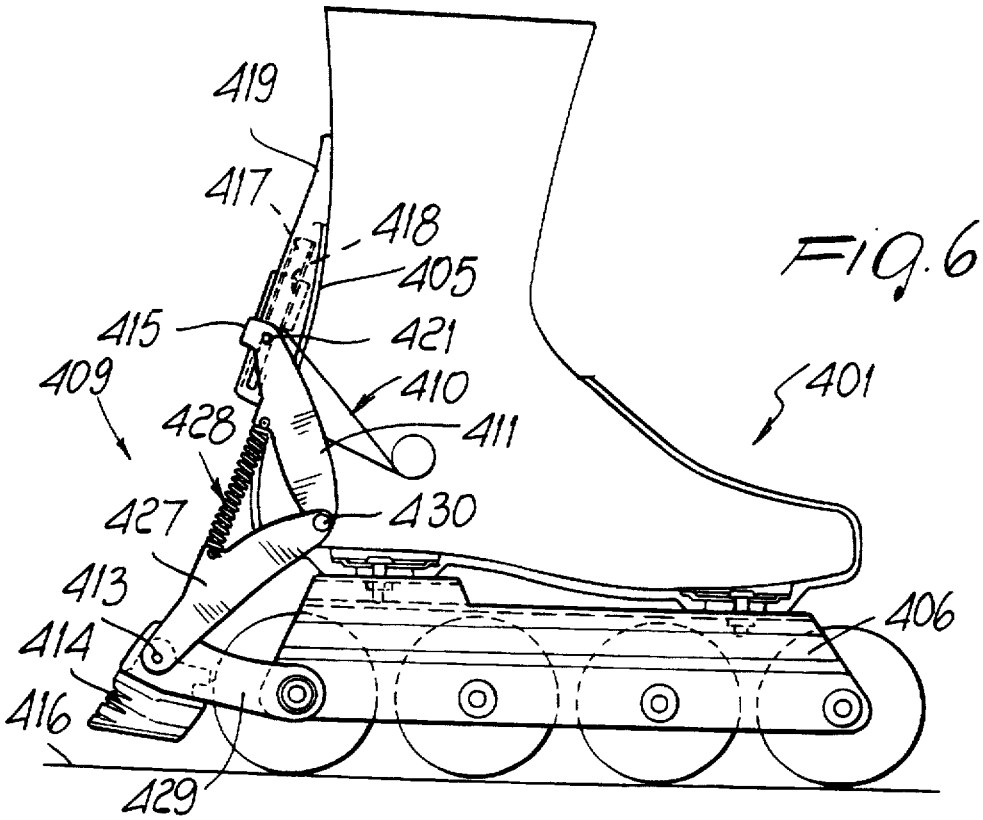
FIG. 6 is a view, similar to the preceding one, of a fifth embodiment of the braking device.

FIG. 6 illustrates still a further embodiment of a braking device 409, wherein the support 410 is again substantially U-shaped; its base 415 is pivoted transversely, by means of the second pivot 421, at the threaded stem 417 that is associated at the complementarily threaded first seat 418 that is formed longitudinally with respect to the tab 419 that protrudes to the rear of the quarter 405.

The support 410 has a pair of first wings 411 that laterally affect the shoe in the region adjacent to the heel; two second wings 427 are freely rotatably pivoted at the free ends of said wings by means of third pivots 430, and said wings are pivoted, at their free end, to the arm 429 by means of the first pivot 413; said arm is in turn oscillatably associated with one end of the frame 406 of the skate 401; a brake 414 is associated with the arm 429.

At least one flexible element, such as a spring 428, can be interposed between said first wings 411 and said second wings 427; said spring constitutes an element for supporting the brake 414 with respect to the ground 416 and a means for compensating for impacts of the brake with the ground as well as for allowing better graduality during braking.

The materials employed, as well as the dimensions of the individual components of the braking device, may of course be the most pertinent according to the specific requirements.

What is claimed is:

1. A skate comprising:

a longitudinally-extending frame for supporting a plurality of wheels;

a shell mounted above said frame;

a quarter articulated to said shell for forward and rearward pivotal movement relative to said shell;

a support including two elastic lateral wings, each of said wings having an upper end and a lower end, said wings having their upper ends coupled to said quarter, said lower ends of said wings moving downwardly in response to said rearward pivotal movement of said quarter and upwardly in response to said forward pivotal movement of said quarter, said lower ends moving towards said upper ends in response to an external compressive force applied to said lower ends and said wings providing a return force that tends to bias said lower ends away from said upper ends when said external compressive force is removed;

a breaking element coupled to the lower ends of said wings and moveable towards and away from a breaking surface in response to the rearward and forward pivotal movement of said quarter.

2. A skate according to claim 1, further comprising means for adjusting the position of said brake with respect to said braking surface.

3. A skate according to claim 1, further comprising means for adjusting the elasticity of said wings of said support.

4. A skate according to claim 1, wherein said lateral wings are arranged laterally to said shell in the region of the heel of the shell.

5. A skate according to claim 4, said skate further including an arm having a first end and a second end, said first end being pivotally coupled to said frame, the lower end of at least one of said lateral wings being pivotally coupled to the second end of said arm, said braking element being coupled to said second end of said arm.

6. A skate according to claim 1, wherein said support has a base that connects said lateral wings and is transversely pivoted to said quarter, said skate further including means for adjusting a position of said base with respect to said quarter and thereby adjusting the position of said brake member with respect to the braking surface.

7. A skate according to claim 6, said skate further including a tab protruding from a rear of said quarter, said means for adjusting a position of said base comprising a threaded stem that is accommodated within an adapted first seat formed longitudinally within said tab.

8. A skate according to claim 7, wherein two mutually parallel slots are formed longitudinally and laterally with respect to said tab, a second pivot being arranged at said slots and providing a pivoting coupling between said threaded stem and said base of said support.

9. A skate according to claim 8, wherein said threaded stem can move axially with respect to said first seat by virtue of a complementarily threaded knob that is associated therewith and is in turn associated, without being able to move axially, with said tab, said knob protruding partially outside said tab so that it can be activated by the user.

10. A skate according to claim 3, wherein said adjusting means comprises blocks removably arranged in third seats formed at a vertex of said lateral wings.

11. A skate according to claim 10, wherein said blocks are T-shaped, with a stem that can be accommodated within said third seats.

12. A skate according to claim 11, wherein said lateral wings of said support are V-shaped, at least one notch being formed at the vertex, said notch increasing the elastic deformation of said wings during braking.

13. A skate according to claim 11, wherein cutouts are formed on said lateral wings.

14. A skate according to claim 1, each of said wings including an upper portion and a lower portion and each of said wings defining a vertex, the upper portions extending from the upper ends to the vertexes of their respective wings, the lower portions extending from the vertexes to the lower ends of their respective wings.

15. A skate according to claim 14, wherein said upper portions are pivotally coupled to said lower portions at the vertex of each wing.

16. A skate according to claim 15, said skate further including a resilient element coupled to the upper and lower portions of at least one of said wings, said resilient element providing a force that resists movement of the lower end of said one wing towards the upper end of said one wing.

17. A skate according to claim 1, said support including a base connecting the upper end of one of said wings to the upper end of the other of said wings, said skate including a pivot that pivotally couples said base to said quarter, said skate further including an adjustable member for selectively displacing said pivot in a transverse direction and thereby selectively adjusting a distance between said base and said braking surface.

18. A skate according to claim 17, said quarter including a tab that protrudes from a rear of said quarter, said tab defining two parallel slots, said pivot extending through said slots.

19. A skate according to claim 18, said tab defining a seat, said adjustable member including a threaded stem disposed in said seat.

20. A skate according to claim 19, said adjustable member further including a threaded knob, said threaded knob being complimentarily threaded to said threaded stem and engaging said threaded stem so rotation of said threaded knob adjusts a position of said threaded stem in said transverse direction.

21. A skate according to claim 1, wherein said braking surface comprises the ground.

22. A braking device for use with a skate assembly, the skate assembly having a longitudinally-extending frame for supporting a plurality of wheels, a shell mounted above said frame, and a quarter articulated to said shell for forward and rearward pivotal movement relative to said shell, said braking device comprising:

a support including two elastic lateral wings, each of said wings having an upper end and a lower end, said upper ends of said wings being configured for coupling to said quarter, said lower ends of said wings moving downwardly in response to said rearward pivotal movement of said quarter and upwardly in response to said forward pivotal movement of said quarter when said upper ends are coupled to said quarter, said lower ends moving towards said upper ends in response to an external compressive force applied to said lower ends and said wings providing a return force that tends to bias said lower ends away from said upper ends when said external compressive force is removed;

a breaking element coupled to the lower ends of said wings and moveable towards and away from a breaking surface in response to the rearward and forward pivotal movement of said quarter when said upper ends are coupled to said quarter.

23. A braking device according to claim 22, wherein said braking surface comprises the ground.

* * * * *